US010329804B2

(12) United States Patent
Evans

(10) Patent No.: US 10,329,804 B2
(45) Date of Patent: Jun. 25, 2019

(54) ADJUSTABLE LENGTH CABLE LOCK AND PACKAGE LOCKING DEVICE, SYSTEM, AND METHOD

(71) Applicant: Dennis Gregory Evans, Edmonton (CA)

(72) Inventor: Dennis Gregory Evans, Edmonton (CA)

( * ) Notice: Subject to any disclaimer, the term of this patent is extended or adjusted under 35 U.S.C. 154(b) by 0 days.

(21) Appl. No.: 15/878,820

(22) Filed: Jan. 24, 2018

(65) Prior Publication Data

US 2018/0209177 A1 Jul. 26, 2018

Related U.S. Application Data

(60) Provisional application No. 62/450,067, filed on Jan. 24, 2017.

(51) Int. Cl.
*E05B 73/00* (2006.01)
*E05B 67/38* (2006.01)

(52) U.S. Cl.
CPC ..... *E05B 73/0005* (2013.01); *E05B 67/383* (2013.01); *E05B 73/00* (2013.01)

(58) Field of Classification Search
CPC ..... E05B 73/0005; E05B 73/0011; E05B 73/0029; E05B 73/00; E05B 67/383
USPC ..... 70/14, 18, 19, 30, 49, 53, 58, 233
See application file for complete search history.

(56) References Cited

U.S. PATENT DOCUMENTS 1,475,256 A * 11/1923 Belair ..... E05B 67/003 24/134 R
4,126,024 A * 11/1978 Timmons ..... B62H 5/003 242/379.2
4,185,361 A * 1/1980 Stuart ..... A63C 11/006 24/16 R
5,823,020 A * 10/1998 Benda ..... E05B 67/003 70/18
6,380,855 B1 * 4/2002 Ott ..... A47F 7/024 340/568.1
6,470,718 B1 10/2002 Yang
6,526,785 B1 3/2003 Asenstorfer et al.
6,629,440 B1 10/2003 Meekma et al.
6,711,921 B1 * 3/2004 Yang ..... E05B 73/0082 248/551
7,784,313 B2 8/2010 Wyers
8,371,004 B2 2/2013 Huber et al.
8,528,370 B2 9/2013 Yu et al.
(Continued)

*Primary Examiner* — Lloyd A Gall
(74) *Attorney, Agent, or Firm* — Holbeche Law; Kevin Edward Holbeche

(57) ABSTRACT

A cable lock, for use with a package and a fixed object, includes cables, a padlock, and a cable tightener. The cables together extend in a loop about the package. The padlock secures the cables to each other in a locked configuration. The cable tightener securely engages and permits longitudinal movement of a cable relative thereto, but only in a tightening direction unless a release is selectively actuated. The cable tightener is securely affixed to the fixed object. In the locked configuration, the cable loop is tightened about the package towards a secured configuration. Then, the cable loop engages and secures the package against the fixed object, such that the package prevents access to the release. Selective unlocking of the padlock permits removal of the package from the cable loop and ready access to the release.

19 Claims, 16 Drawing Sheets

(56) References Cited

U.S. PATENT DOCUMENTS

| | | | | |
|---|---|---|---|---|
| 8,640,509 | B2 * | 2/2014 | Will | E05B 45/005 70/14 |
| 9,388,606 | B2 | 7/2016 | Garthe et al. | |
| 9,394,727 | B2 | 7/2016 | Fawcett et al. | |
| 2001/0031588 | A1 * | 10/2001 | Young | E05B 73/007 441/74 |
| 2002/0134119 | A1 * | 9/2002 | Derman | E05B 73/00 70/58 |
| 2009/0113946 | A1 * | 5/2009 | Baumgarten | E05B 67/006 70/18 |
| 2018/0202199 | A1 * | 7/2018 | Critz | E05B 73/0023 |

* cited by examiner

ADJUSTABLE LENGTH CABLE LOCK AND PACKAGE LOCKING DEVICE, SYSTEM, AND METHOD

FIELD OF THE INVENTION

The invention relates generally to the field of locks and locking systems and methods and, more particularly, to an adjustable length cable lock and package locking device, system, and method.

BACKGROUND OF THE INVENTION

People and businesses may wish to make increasing use of couriers for delivery of parcels, including to homes unattended by intended parcel recipients. An intended recipient may wish to secure a received parcel, even when not at home, against risk of theft. Otherwise, a thief may steal a parcel left unattended outside the home. Couriers, and companies with a large home delivery component in their business models, may benefit from a device, system, or method that makes it more difficult for would-be thieves to steal parcels left unattended outside the home.

Ideally, such a device, system, or method might be usable with a wide variety of parcel sizes, might require a courier to spend only a few moments in securing a parcel, and might require a home user to spend only a few moments in releasing a secured parcel—all while making it more difficult for a would-be thief to otherwise make off with the parcel. And, with increased confidence in parcel delivery, even while users are away, the economy may see increased adoption of courier home delivery, greater profits for associated businesses, and greater customer satisfaction and confidence.

In fields far removed from any associated with courier delivery of parcels, it may have been known, for example, to provide retail security devices with spools that unwind cable loops of desired lengths to wrap around merchandise articles, and with locking mechanisms that otherwise prevented the unwinding of those spools.

In other fields, it may have been known to provide a lock with a cable secured to, and slidably received within, a housing. The cable may have been slidable between a locked position (whereat an otherwise movable item was secured to a fixed object) and an unlocked position (whereat the item could be removed from the fixed object). A rotatable locking mechanism may have alternately allowed the cable to slide between different locked positions, and/or prevented its movement in the locked position. Variations on such locks also may have been known, including a variety of different devices, e.g., as follows: wherein an end of a cable fixed to a slidable locking device may have been detachable; wherein both ends of a cable may have been able to slide through the lock in a tightening direction when locked; or wherein the lock may have been unlocked by turning a dial to a correct sequence.

Further, it may have been known to provide a locking device having two movable clamp jaws and an actuation lever designed to receive a padlock in a locked position. Elsewhere, it may have been known to provide a tightening device with a movable clamping jaw that permitted a shoelace to be tightened only, with a lever that may have been pressed to release the clamping jaws and loosen the shoelace.

It additionally may have been known to provide a lock, for an adjustable cable loop, with three locking positions. The cable may have been freely movable (relative to the lock) in the first position, only tightenable in the second position, and of fixed length and not adjustable in the third position.

Prior art and/or art in non-analogous fields may have suffered from one or more shortcomings and/or disadvantages which may preferably be readily appreciable by and/or suggested, in view of the teachings and/or disclosures hereof, to those skilled in the art associated with courier delivery of parcels.

What may be needed is a device with a cable tightening mechanism and a separate locking mechanism that does not directly affect the function of the cable tightening mechanism. What may be needed is a such device which also enables lengthening of the cable loop, while the cable loop is locked, if an item has not yet been secured by the device.

There may be a need for a device, system and/or method which:

- can be used to lock and/or secure parcels delivered by a courier;
- adjusts to fit a wide variety of parcel sizes;
- permits a parcel to be placed in a cable loop, and/or with a handle on an end of the cable being pulled to tighten the cable about the parcel;
- takes a courier only a few moments (e.g., perhaps about 10-15 seconds) to secure a parcel;
- permits the cable to move freely through a mechanism to allow the cable to tighten about the parcel, and/or restrains the cable from being loosened or released until the owner unlocks and removes the parcel;
- will give a user confidence that a parcel delivered to the user's home, while the user is away, will be there when the user returns;
- permits an owner to remove a first parcel and make it ready for a second parcel in only a few moments (e.g., perhaps about 20-30 seconds);
- uses a simple mechanism; and/or
- is easy to use.

It is an object of the present invention to obviate or mitigate one or more disadvantages and/or shortcomings associated with the prior art, to meet or provide for one or more needs and/or advantages, and/or to achieve one or more objects of the invention—one or more of which may preferably be readily appreciable by and/or suggested to those skilled in the art in view of the teachings and/or disclosures hereof.

SUMMARY OF THE INVENTION

According to the invention, there is disclosed an adjustable length cable lock and a package locking system and method wherein a parcel may preferably be placed in a cable loop, and/or a handle on an end of the cable may preferably be pulled to tighten the cable about the parcel. The cable may preferably move freely through a mechanism to allow the cable to tighten about the parcel, and/or preferably may not be released until a user unlocks and removes the parcel.

According to the invention, there is also disclosed an adjustable length cable lock which may include a selectively releasable cable tightening device, a locking mechanism, a first cable, and/or a second cable. The cable tightening device may be secured to a fixed object. A cable may move through the cable tightening device, only in a tightening direction unless a release mechanism is selectively actuated. The first cable may have a first securing end portion looped and/or crimped to receive the locking mechanism, and a secured end portion which may be secured to the fixed object. The second cable may pass through the cable tightening device, and may have: a second securing end portion looped and/or crimped to receive the locking mechanism in order to be securely locked to the first securing end portion of the first cable; and a handle end portion with a handle that may be pulled to tighten a cable loop formed by the securely locked first and second cables. The adjustable length cable lock may be designed to secure a portable item against the fixed object such that the presence of the portable item, thus secured, may prevent access to the release mechanism.

According to an aspect of the invention, the secured end portion of the first cable may preferably, but need not necessarily, be secured to the affixing member by one or more cable fasteners.

According to an aspect of the invention, the cable tightening device may preferably, but need not necessarily, be secured to the fixed object by one or more object fasteners.

According to the invention, there is also disclosed an adjustable length cable lock, for use with a portable item and a fixed object. The adjustable length cable lock may include one or more elongate cable members, a locking mechanism, a cable tightening device, and/or an affixing member. The cable members may include first and second securing end portions. The cable members may be adapted to extend in a cable loop about the portable item. The locking mechanism may securely lock the first and second securing end portions to each other in a locked configuration. The locking mechanism may be selectively unlockable to permit removal of the first and second securing end portions from each other. The cable tightening device may have a selectively actuable release mechanism. The cable tightening device may securely engage and permit longitudinal movement of at least one of the cable members relative to the cable tightening device, but only in a tightening direction unless the release mechanism is selectively actuated. The affixing member may be secured to the fixed object and/or it may secure the cable members, the locking mechanism, and/or the cable tightening device to the fixed object. In the locked configuration, the aforesaid movement in the tightening direction may operatively tighten the cable loop about the portable item towards a secured configuration. In the secured configuration, the cable loop may engage and secure the portable item against the fixed object, such that the portable item may prevent access to the release mechanism. The aforesaid selective unlocking of the locking mechanism may permit removal of the portable item from the cable loop and/or ready access to the release mechanism.

According to an aspect of the invention, the cable members may preferably, but need not necessarily, include a first cable and/or a second cable. The first securing end portion may preferably, but need not necessarily, be provided on the first cable. The second securing end portion may preferably, but need not necessarily, be provided on the second cable.

According to an aspect of the invention, the cable tightening device may preferably, but need not necessarily, define a cable passage therethrough. The second cable may preferably, but need not necessarily, slidably extend through the cable passage and may preferably, but need not necessarily, be securely engaged by the cable tightening device.

According to an aspect of the invention, the release mechanism may preferably, but need not necessarily, include a release lever.

According to an aspect of the invention, the locking mechanism may preferably, but need not necessarily, include a padlock which, preferably, may be unlocked by a key.

According to an aspect of the invention, the affixing member may preferably, but need not necessarily, include one or more cable fasteners. One of the cable members may preferably, but need not necessarily, have a secured end portion which may preferably, but need not necessarily, be secured to the affixing member by the cable fasteners.

According to an aspect of the invention, the affixing member may preferably, but need not necessarily, include one or more object fasteners. The affixing member may preferably, but need not necessarily, be secured to the fixed object by the object fasteners.

According to an aspect of the invention, the affixing member may preferably, but need not necessarily, securely engage the cable tightening device and/or the fixed object.

According to an aspect of the invention, the locking mechanism may preferably, but need not necessarily, have a lock fastener which, preferably, may be selectively: fastened to the fixed object, e.g., when the adjustable length cable lock is not in use; and/or unfastened from the fixed object, e.g., when the adjustable length cable lock is in use.

According to an aspect of the invention, the cable tightening device may preferably, but need not necessarily, define a release aperture. The release mechanism may preferably, but need not necessarily, be accessible via the release aperture. The portable item, preferably when secured by the cable loop against the fixed object, may preferably, but need not necessarily, block the release aperture to preferably, but not necessarily, prevent access to the release mechanism.

According to the invention, there is also disclosed a system and/or method for producing the adjustable length cable lock, a system and/or method of using the adjustable length cable lock to secure a portable item to a fixed object, and/or a system and/or method of using the adjustable length cable lock to release a portable item from a fixed object.

Other advantages, features and characteristics of the present invention, as well as methods of operation and functions of the related elements of the structure, and the combination of parts and economies of manufacture, will become more apparent upon consideration of the following detailed description with reference to the accompanying figures, the latter of which are briefly described hereinbelow.

BRIEF DESCRIPTION OF THE DRAWINGS

The novel features which are believed to be characteristic of the adjustable length cable lock and package locking device, system, and method according to the present invention, as to their structure, organization, use and method of operation, together with further objectives and advantages thereof, will be better understood from the following figures in which presently preferred embodiments of the invention will now be illustrated by way of example. It is expressly understood, however, that the figures are for the purpose of illustration and description only, and are not intended as a definition of the limits of the invention. In the accompanying figures.

DETAILED DESCRIPTION OF PREFERRED EMBODIMENTS

Figure 1:
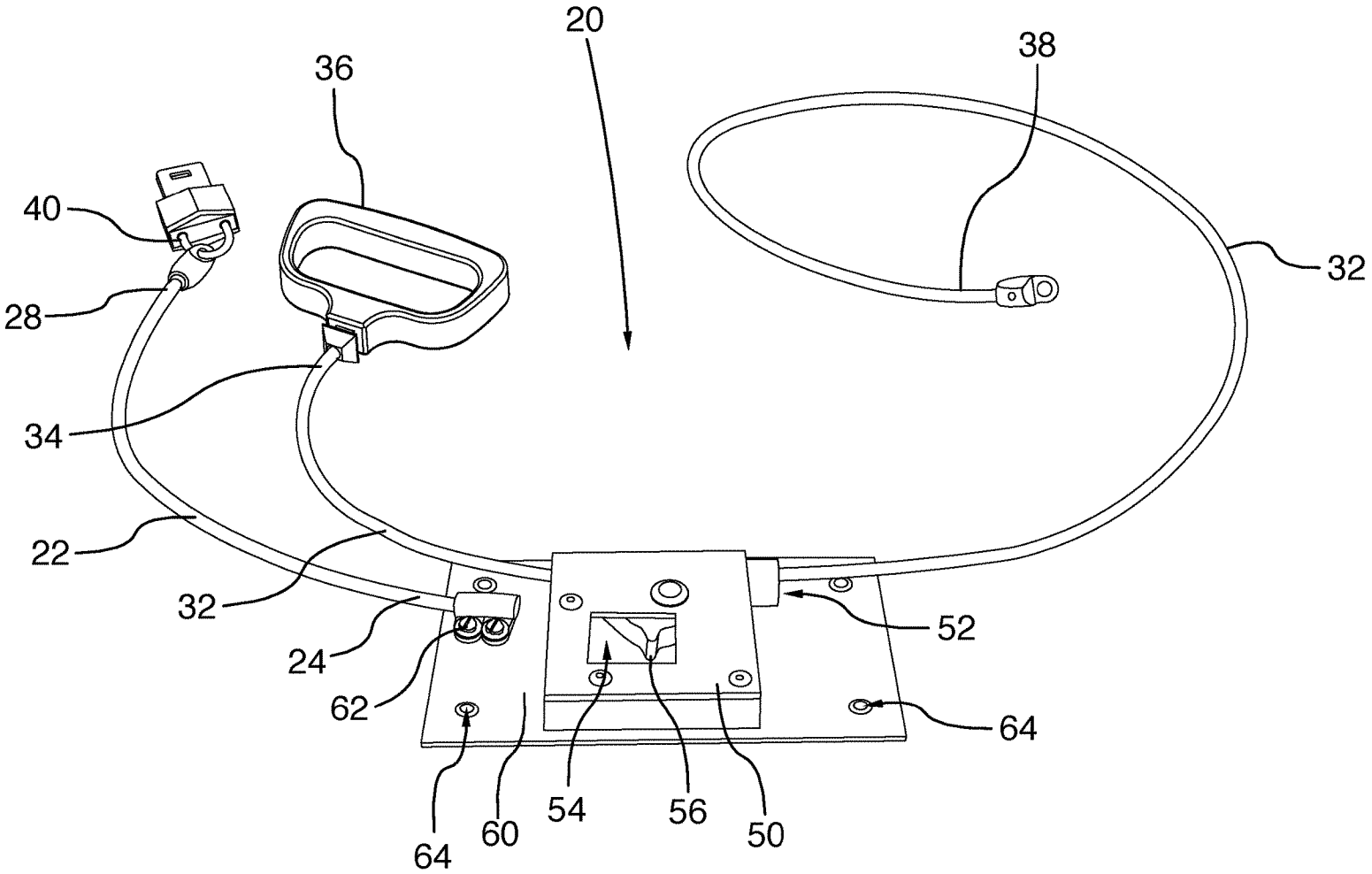
FIG. 1 is a front left perspective view of an adjustable length cable lock device according to a first preferred embodiment of the invention, shown in an unlocked configuration, without a package, with one cable in a loosened position.

There is shown in accompanying FIGS. 1-11 a preferred embodiment of an adjustable length cable lock device 20, in use with a portable item 16 and a fixed object 18, according to the invention. The adjustable length cable lock 20 preferably includes elongate first and second cables 22, 32 adapted to extend in a cable loop about the portable item 16 (as shown in FIGS. 8-11). As shown in FIGS. 1-2 and 4-5, the adjustable length cable lock 20 also preferably includes a locking mechanism 40, a cable tightening device 50, and an affixing member 60.

As shown in FIGS. 1-2 and 4-5, the first cable 22 preferably has a first securing end portion 28 and an opposing secured end portion 24. The secured end portion 24 is preferably secured to the affixing member 60 by cable fasteners 62 (as shown in FIGS. 1-2, 4-5 and 7). At the other end of the first cable 22, the first securing end portion 28 is preferably looped or crimped to receive the locking mechanism 40 (as shown in FIGS. 1-6).

As shown in FIGS. 1-2 and 4-5, the second cable 32 preferably has a handle end portion 34 and a second securing end portion 38. The second securing end portion 38 is preferably looped or crimped to receive the locking mechanism 40 (as shown in FIGS. 2-6).

Figure 2:
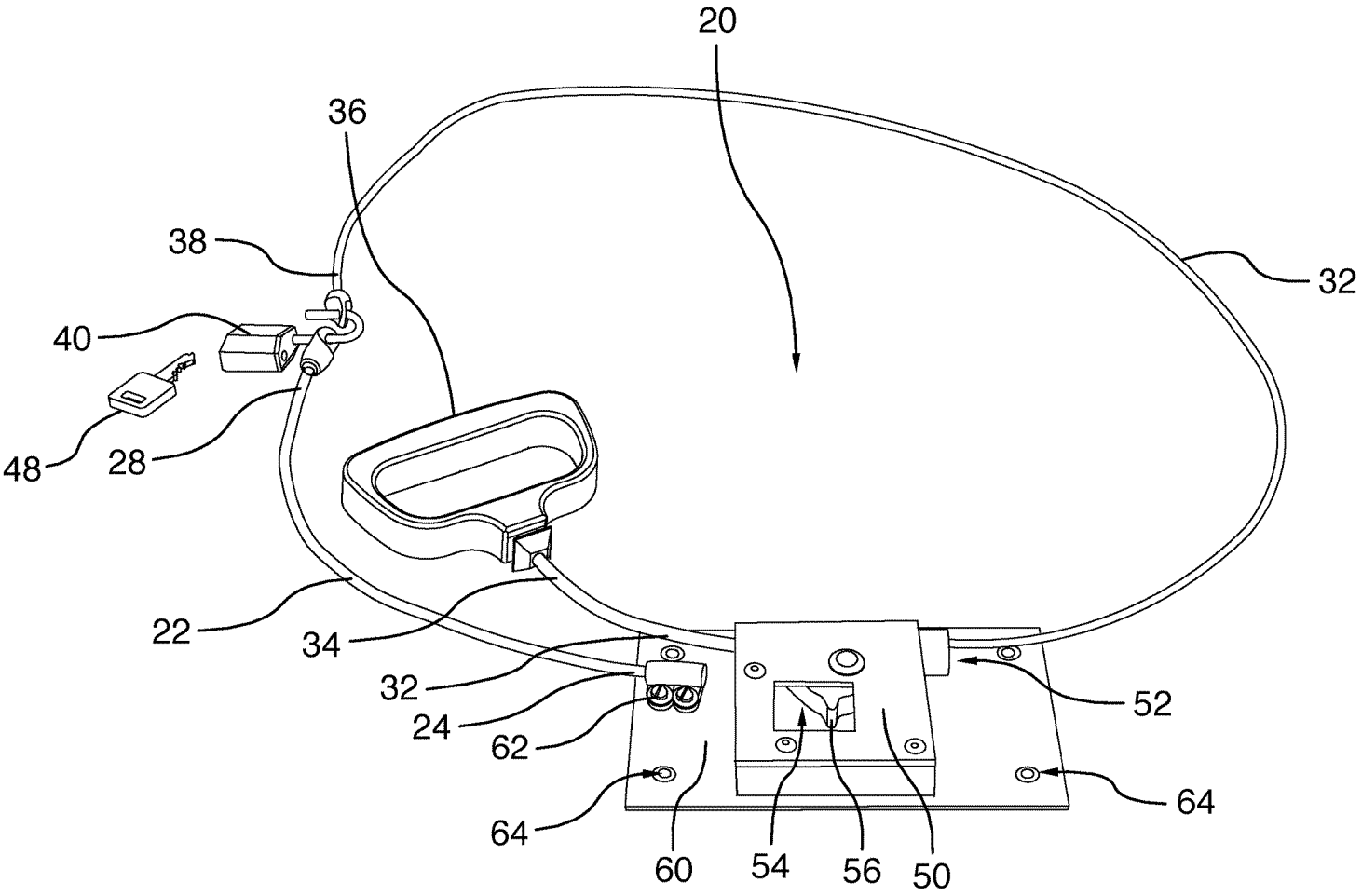
FIG. 2 is a front left perspective view of the adjustable length cable lock device of FIG. 1, shown with first and second cables engaged by a padlock in the unlocked configuration.
Figure 3:
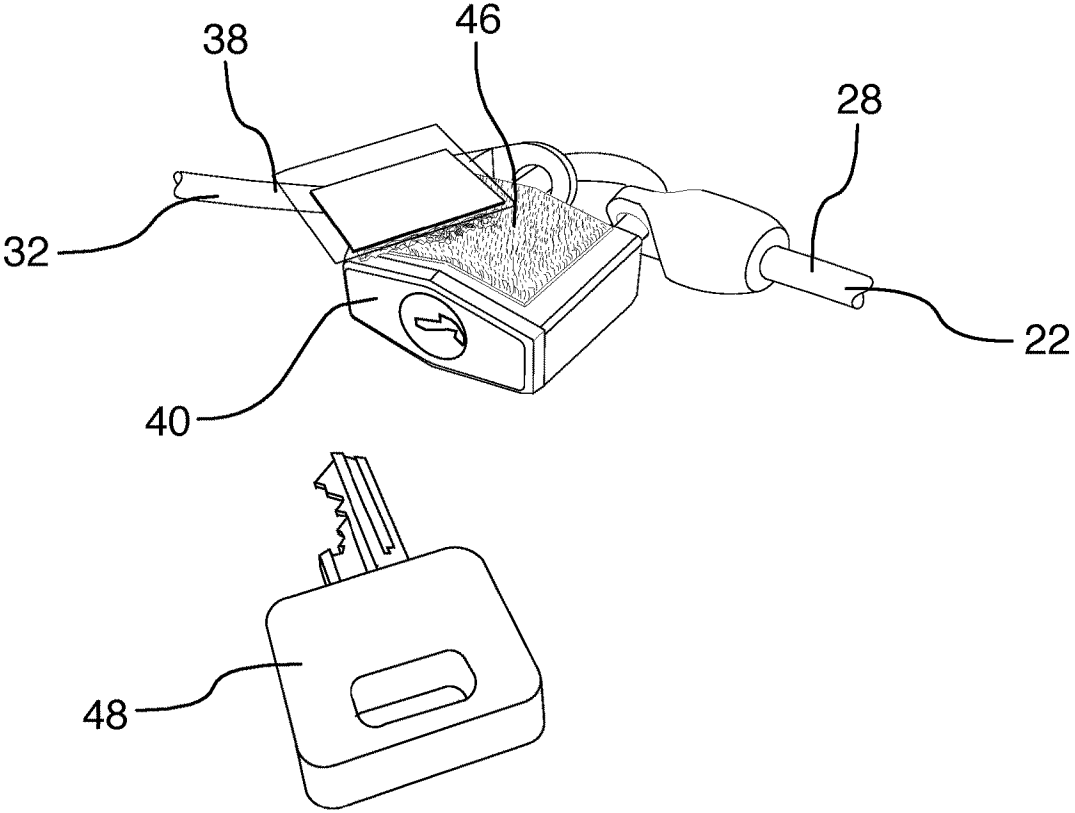
FIG. 3 is a close-up view of the adjustable length cable lock device of FIG. 1, showing the cables in a locked configuration.
Figure 4:
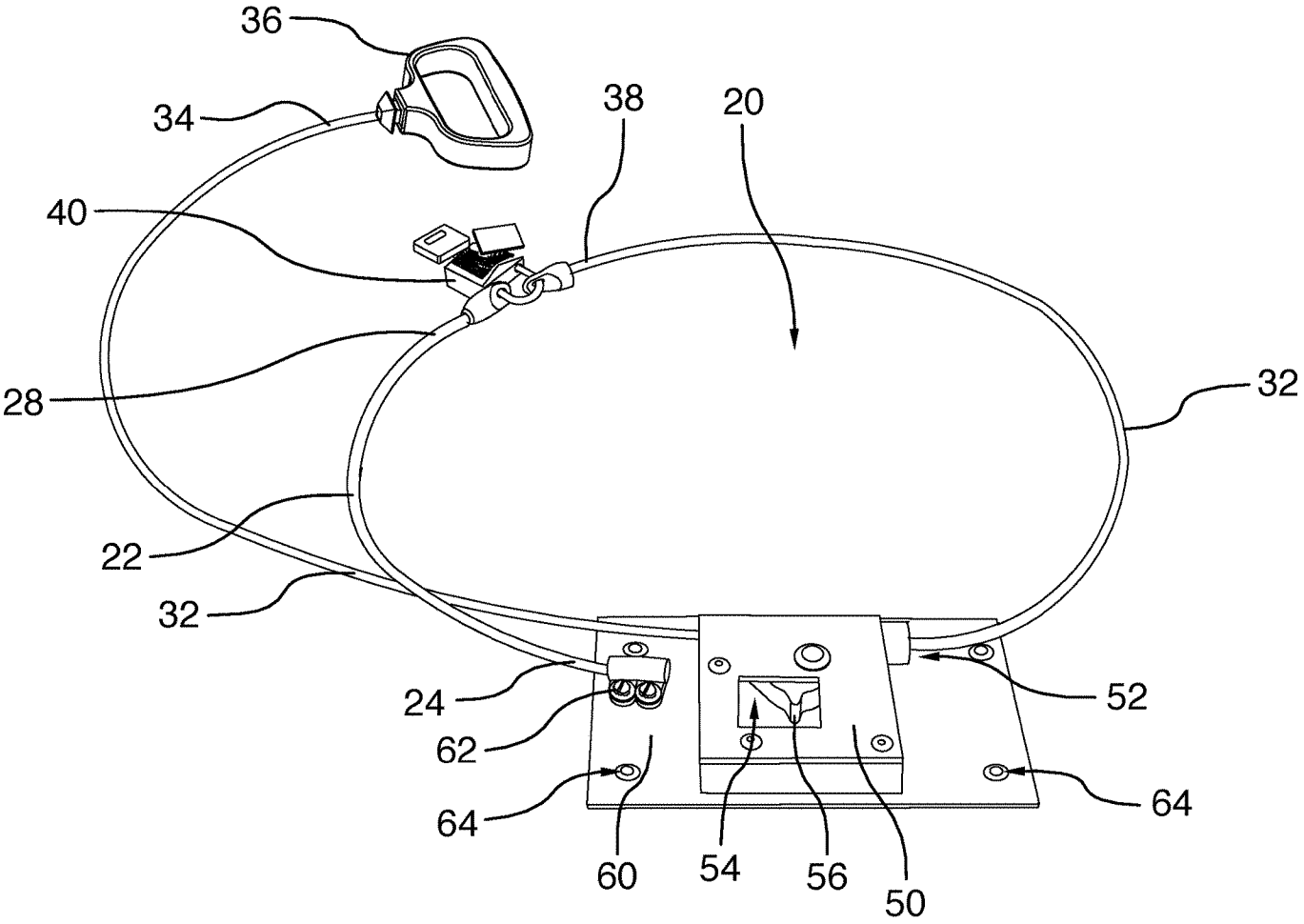
FIG. 4 is a front left perspective view of the adjustable length cable lock device of FIG. 1, showing the cables in the locked configuration, and shown with a cable loop in a partially tightened configuration.
Figure 5:
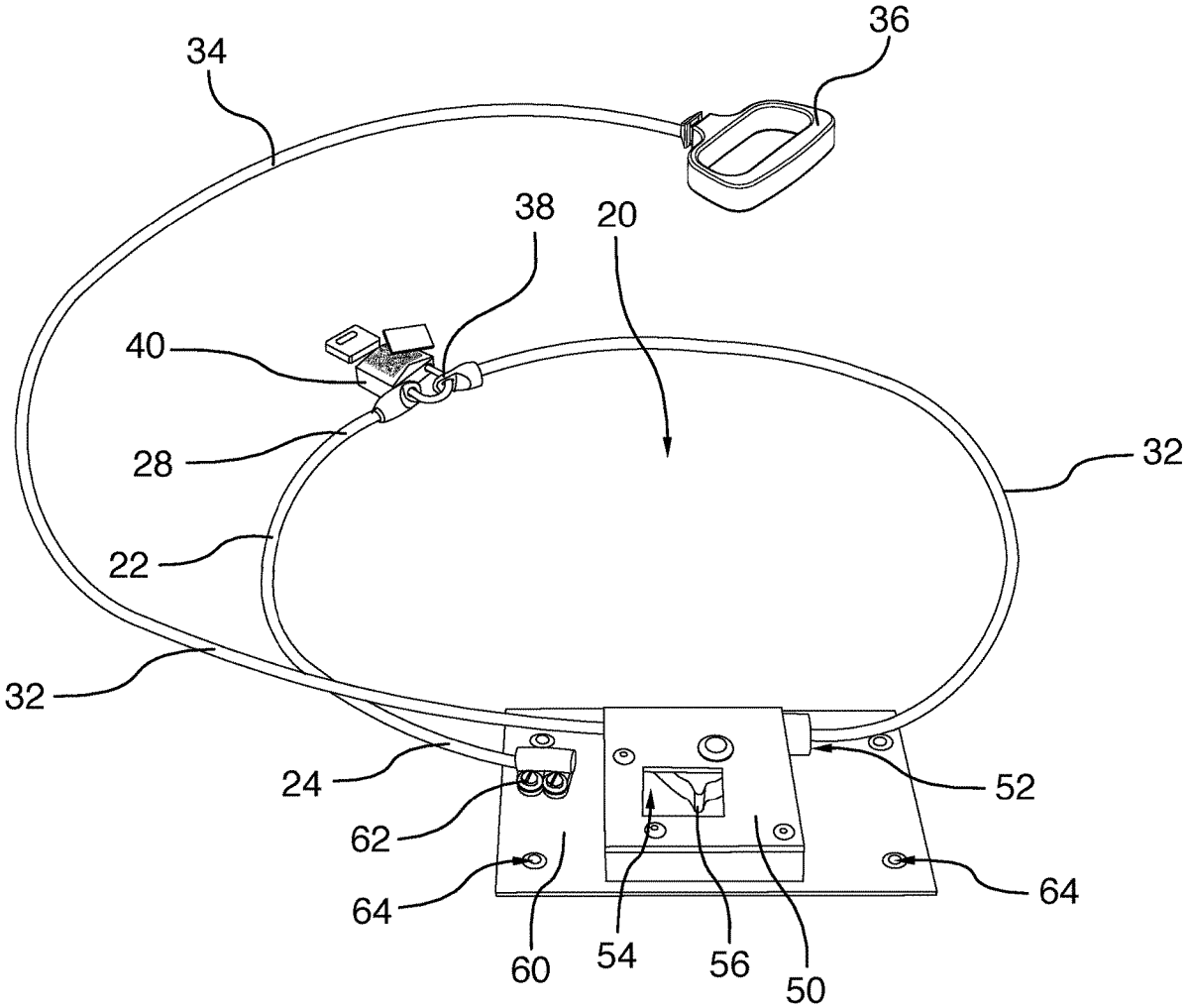
FIG. 5 is a front left perspective view of the adjustable length cable lock device of FIG. 1, shown with the cable loop in a tightened configuration.
Figure 6:
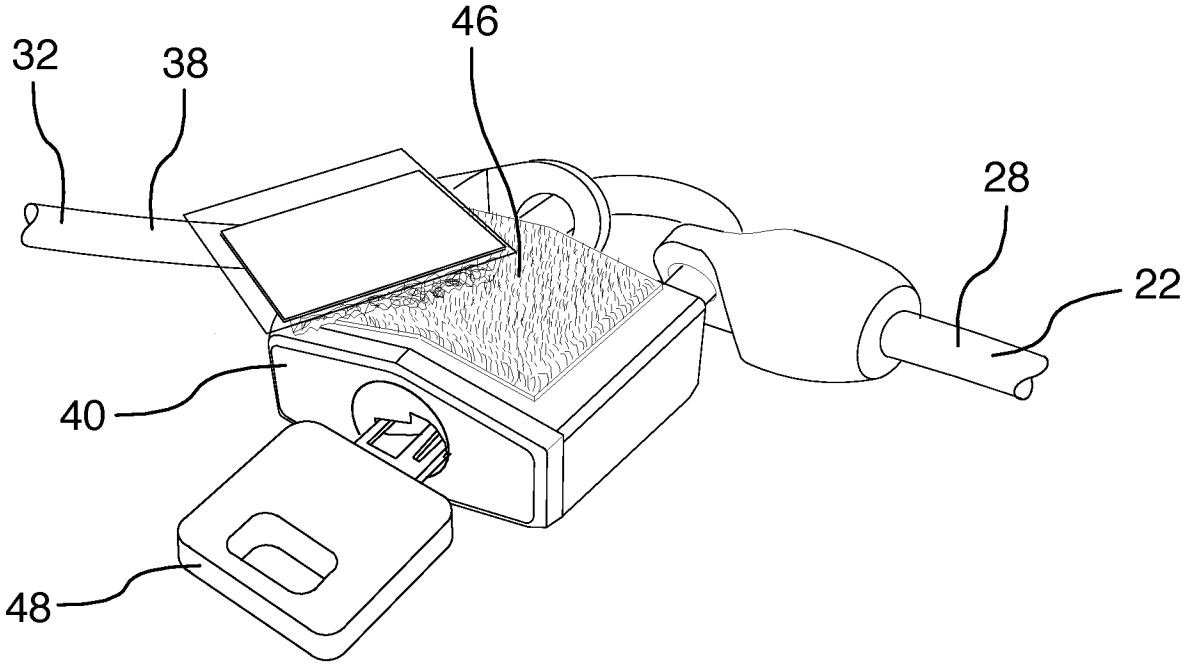
FIG. 6 is a close-up view of the adjustable length cable lock device of FIG. 1, showing a velcro lock fastener thereof, and showing the cables in the locked configuration.

The locking mechanism 40 preferably is in the form of a padlock which may be unlocked by a key 48 (as best seen in FIGS. 1 and 2). Via the locking mechanism 40, the first and second securing end portions 28, 38 of the first and second cables 22, 32, respectively, may be securely locked to each other (as best seen in FIGS. 3 and 6) to, in a locked configuration, together form a cable loop (as shown in FIGS. 1-2, 4-5 and 8).

Figure 9:
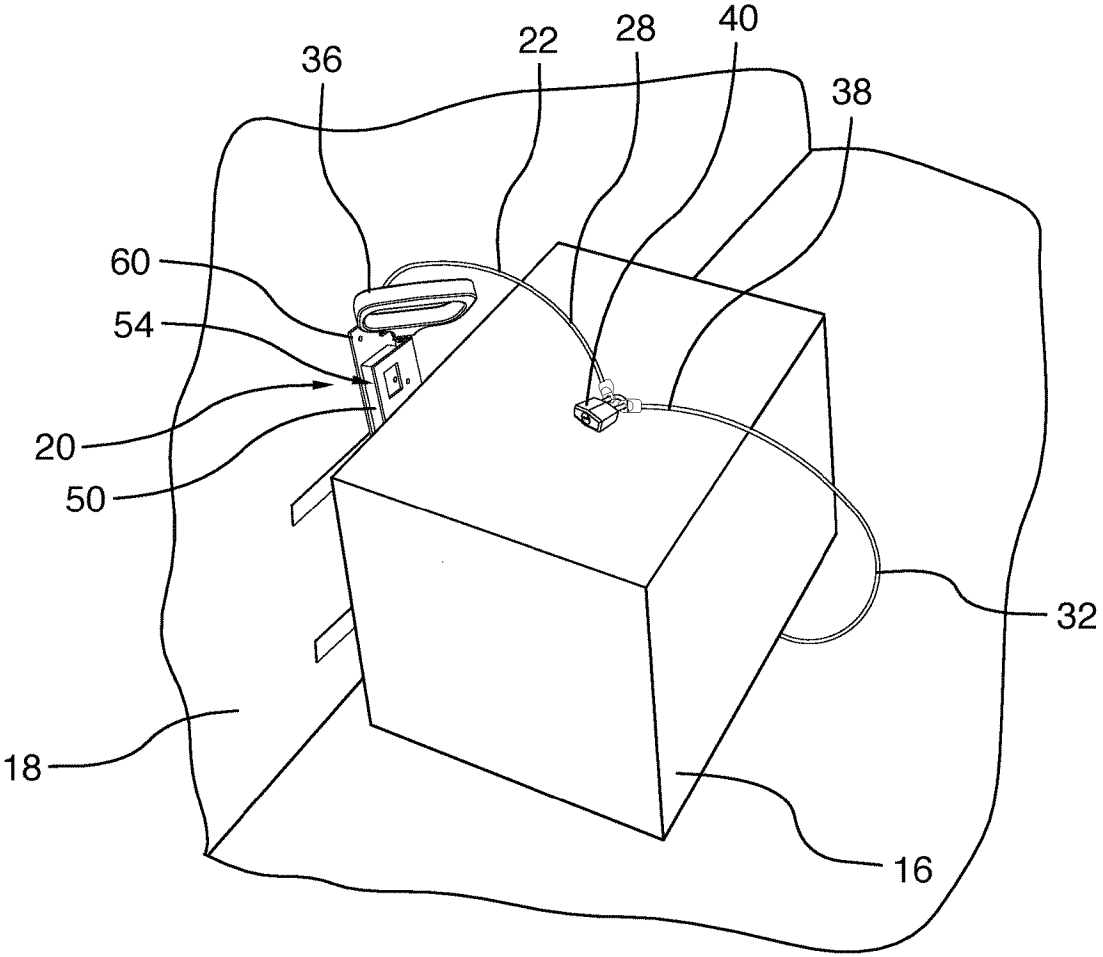
FIG. 9 is a front left perspective view of the adjustable length cable lock device of FIG. 1, shown mounted to the wall and shown with the cable loop, in a loosened position, about a package.
Figure 10:
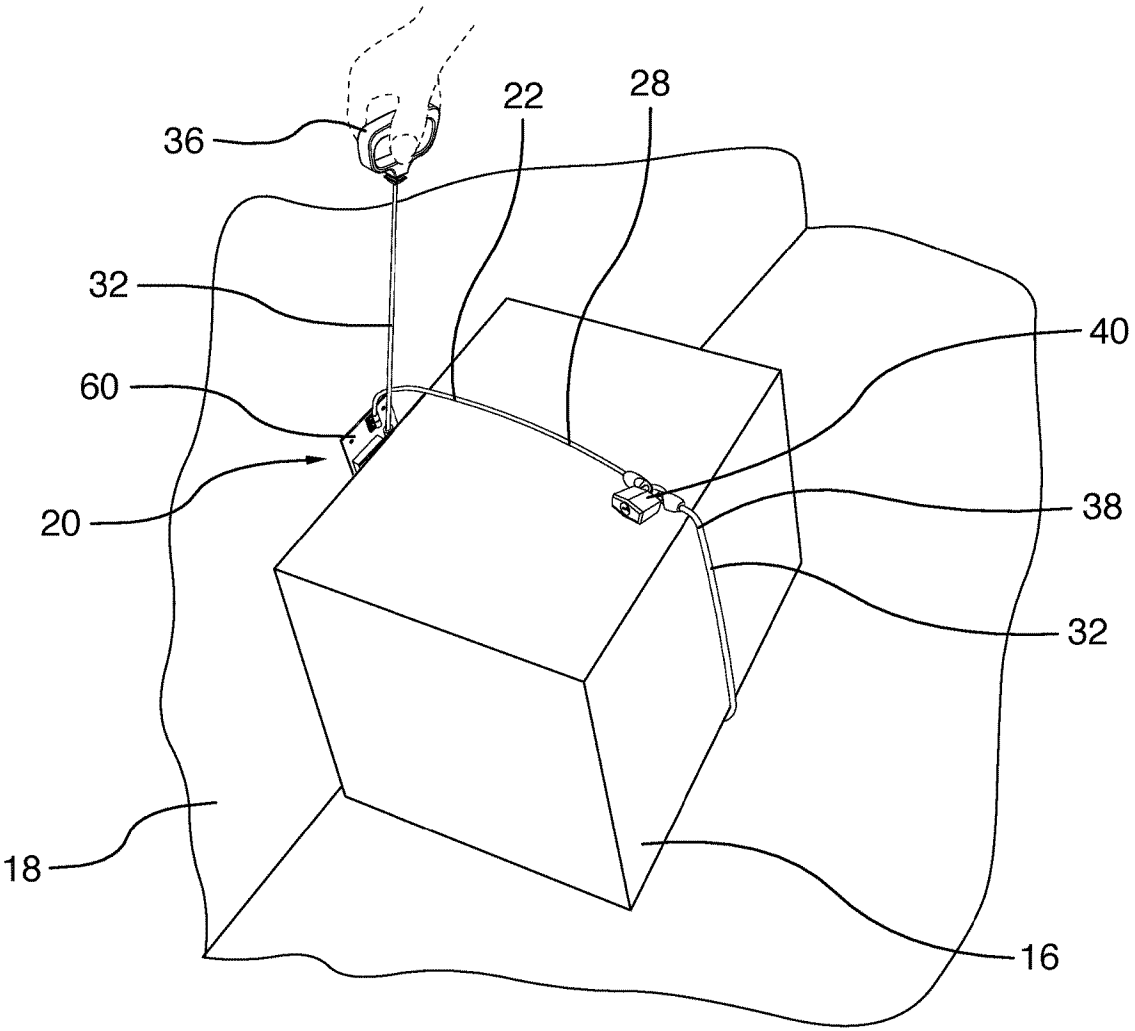
FIG. 10 is a front left perspective view of the adjustable length cable lock device of FIG. 1, shown mounted to the wall and shown with the cable loop, in the partially tightened configuration, about the package.

The handle end portion 34 of the second cable 32 is provided with a handle 36 that may be pulled (as shown in FIGS. 9-10) to tighten the cable loop formed by the securely locked first and second cables 22, 32.

Figure 7:
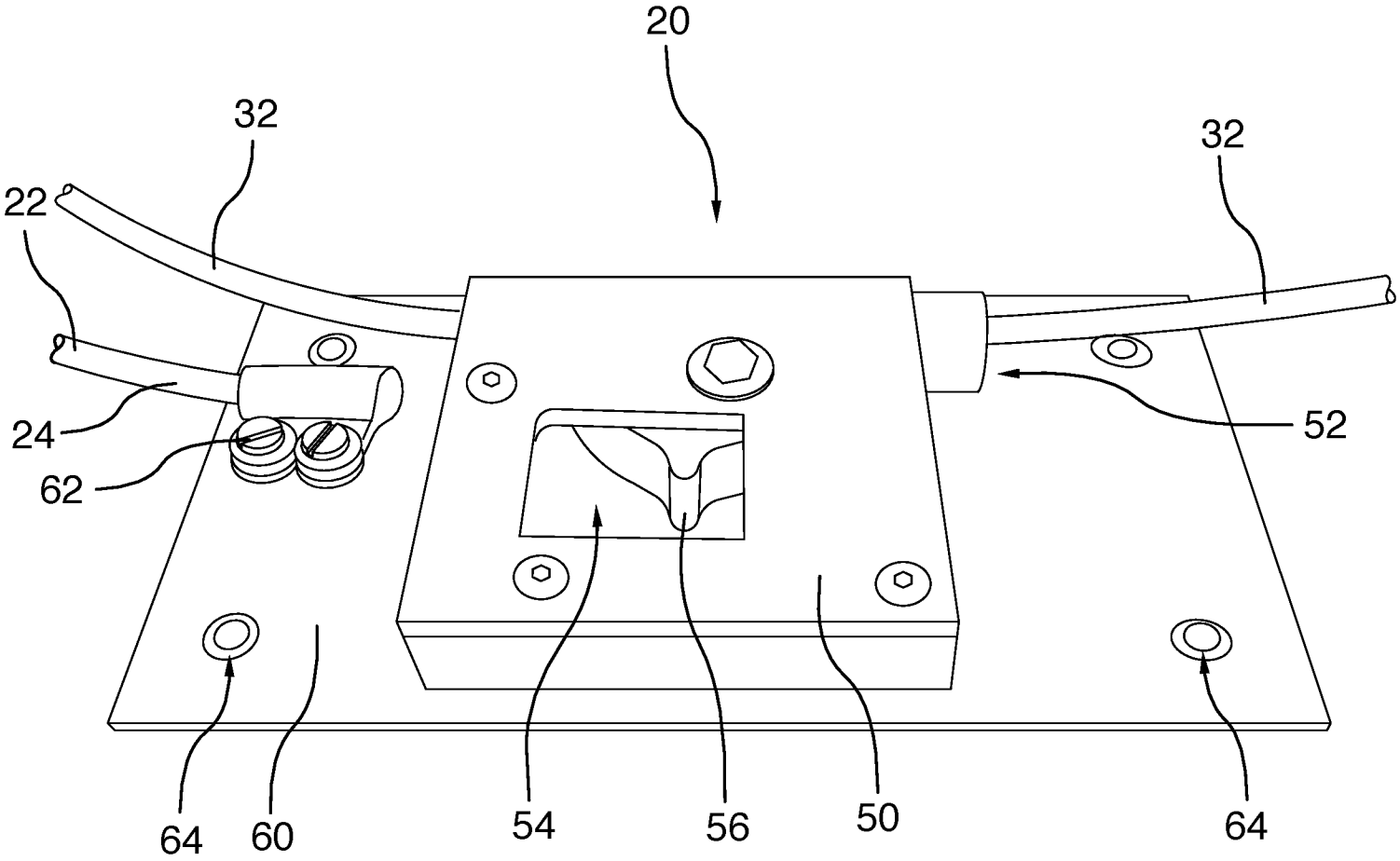
FIG. 7 is a close-up front left perspective view of the adjustable length cable lock device of FIG. 1, showing an affixing member and a cable tightening device thereof.

As best seen in FIG. 7, the cable tightening device 50 preferably defines a release aperture 54. The cable tightening device 50 preferably has a selectively actuable release mechanism 56, in the form of a release lever, which is accessible via the release aperture 54. The cable tightening device 50 preferably defines a cable passage 52 therethrough. Preferably, the second cable 32 slidably extends through the cable passage 52. Preferably, the cable tightening device 50 securely engages and permits longitudinal movement of the second cable 32 relative to the cable tightening device 50, but only in a tightening direction unless the release mechanism 56 is selectively actuated.

Figure 7A:
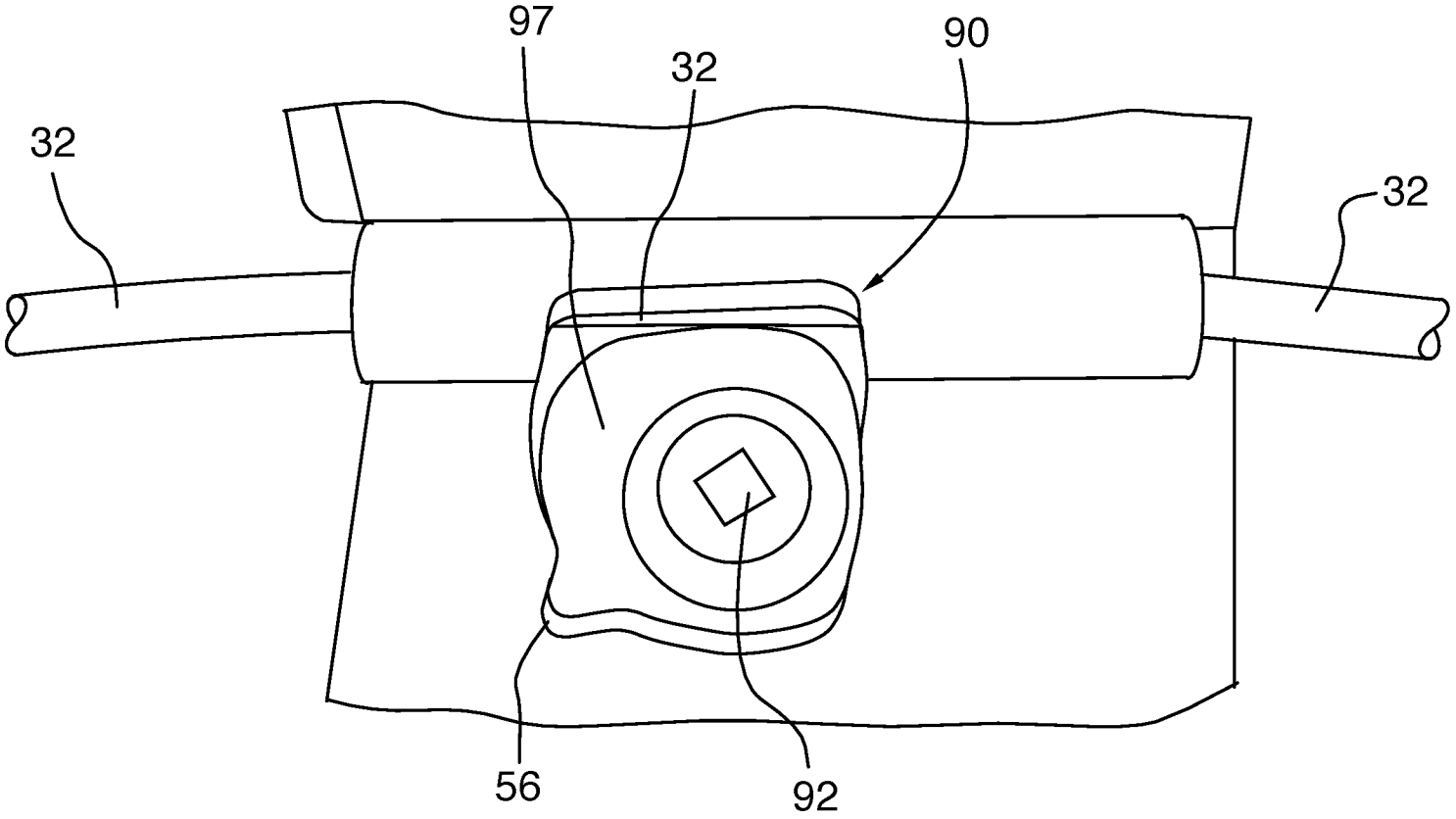
FIG. 7A is a close-up view of interior workings of a cable tightening device like that shown in FIG. 7.

As shown in FIG. 7A, the cable tightening device 50 may preferably include a release cam portion 97 engaging the release lever 56. Together, the cam portion 97 and the release lever 56 pivot about a cam pivot 92. The cam portion 97 extends, through a cam aperture 90, into the cable passage 52. There, the cam portion 97 securely engages the second cable 32, so as to restrict movement other than in the tightening direction, unless the release lever 57 is selectively actuated. When the release lever 57 is selectively actuated, the cam portion 97 disengages the second cable 32 and permits free longitudinal movement of the second cable 32 both in the tightening direction and otherwise.

Figure 8:
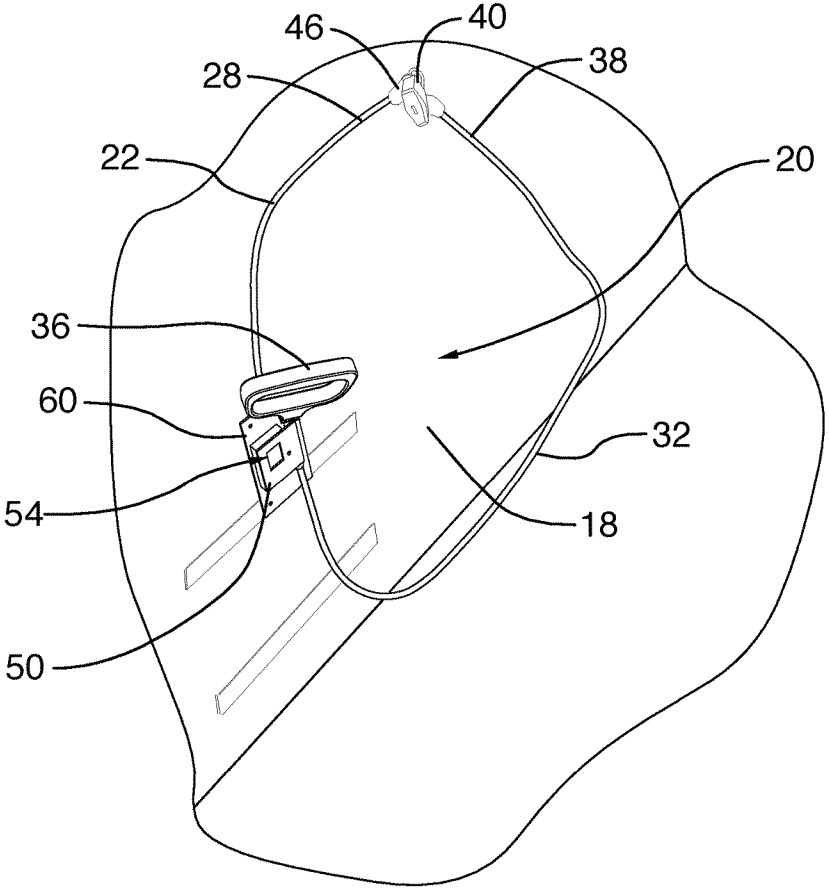
FIG. 8 is a front left perspective view of the adjustable length cable lock device of FIG. 1, shown mounted to a wall and shown with an alternate lock fastener in the form of a wall-mounted hook.

As shown in FIG. 8, the affixing member 60 is preferably secured to the fixed object 18 (e.g., a wall) by object fasteners 64. The affixing member 60 preferably securely engages the cable tightening device 50 and the fixed object 18. Preferably, in this manner, the cable tightening device 50 (and the rest of the adjustable length cable lock 20) is secured to the fixed object 18.

Figure 11:
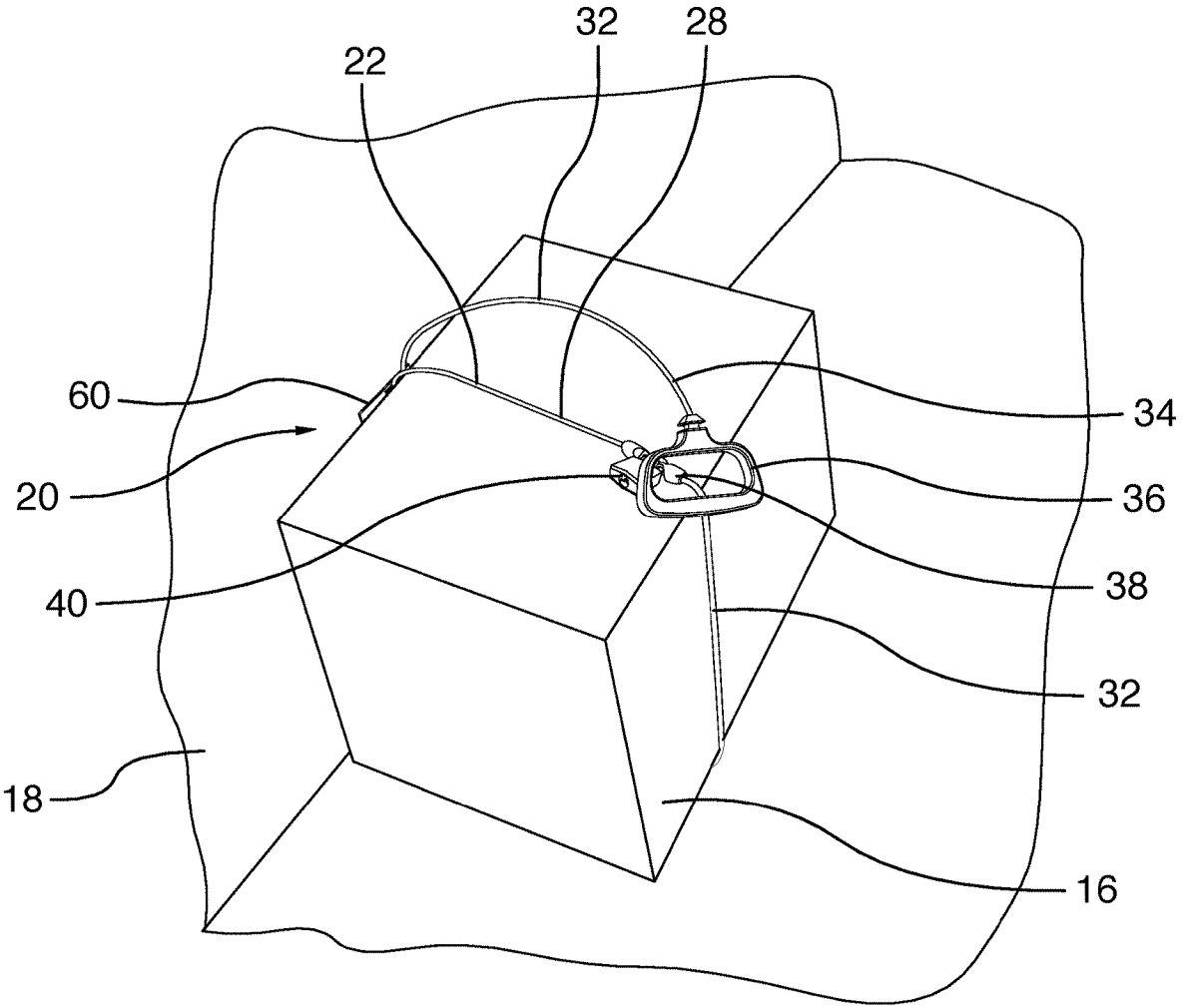
FIG. 11 is a front left perspective view of the adjustable length cable lock device of FIG. 1, shown mounted to the wall and shown with the cable loop, in the tightened configuration, about the package

Preferably, in the locked configuration, the aforesaid movement in the tightening direction operatively tightens the cable loop about the portable item 16 (as shown in FIGS. 9-10) towards a secured configuration (as shown in FIG. 11).

In the secured configuration shown in FIG. 11, the cable loop preferably engages and secures the portable item 16 against the fixed object 18, such that the portable item 16 blocks the release aperture 54 to prevent access to the release mechanism 56.

Preferably, the locking mechanism 40 is selectively unlockable to permit removal of the first and second securing end portions 28, 38 from each other. This selective unlocking of the locking mechanism 40 preferably permits removal of the portable item 16 from the cable loop and ready access to the release mechanism 56.

A lock fastener 46 (e.g., velcro as best seen in FIG. 6 or a wall-mounted hook in FIG. 8) is preferably provided to selectively fasten the padlock to the fixed object 18 when the adjustable length cable lock 20 is not in use, and unfasten the padlock from the fixed object 18 when the adjustable length cable lock 20 is in use.

There is shown in accompanying FIGS. 12-15 a second preferred embodiment of an adjustable length cable lock device 20' according to the invention. The adjustable length cable lock device 20'—much like the embodiment shown in FIGS. 1 to 11—preferably includes a locking mechanism 40, and elongate first and second cables 22, 32 adapted to extend in a cable loop about the portable item 16 (as shown in FIGS. 8-11). As shown in FIGS. 12 to 15, the adjustable length cable lock 20' also preferably includes an affixing member 60 and a cable tightening device 50'.

Figure 12:
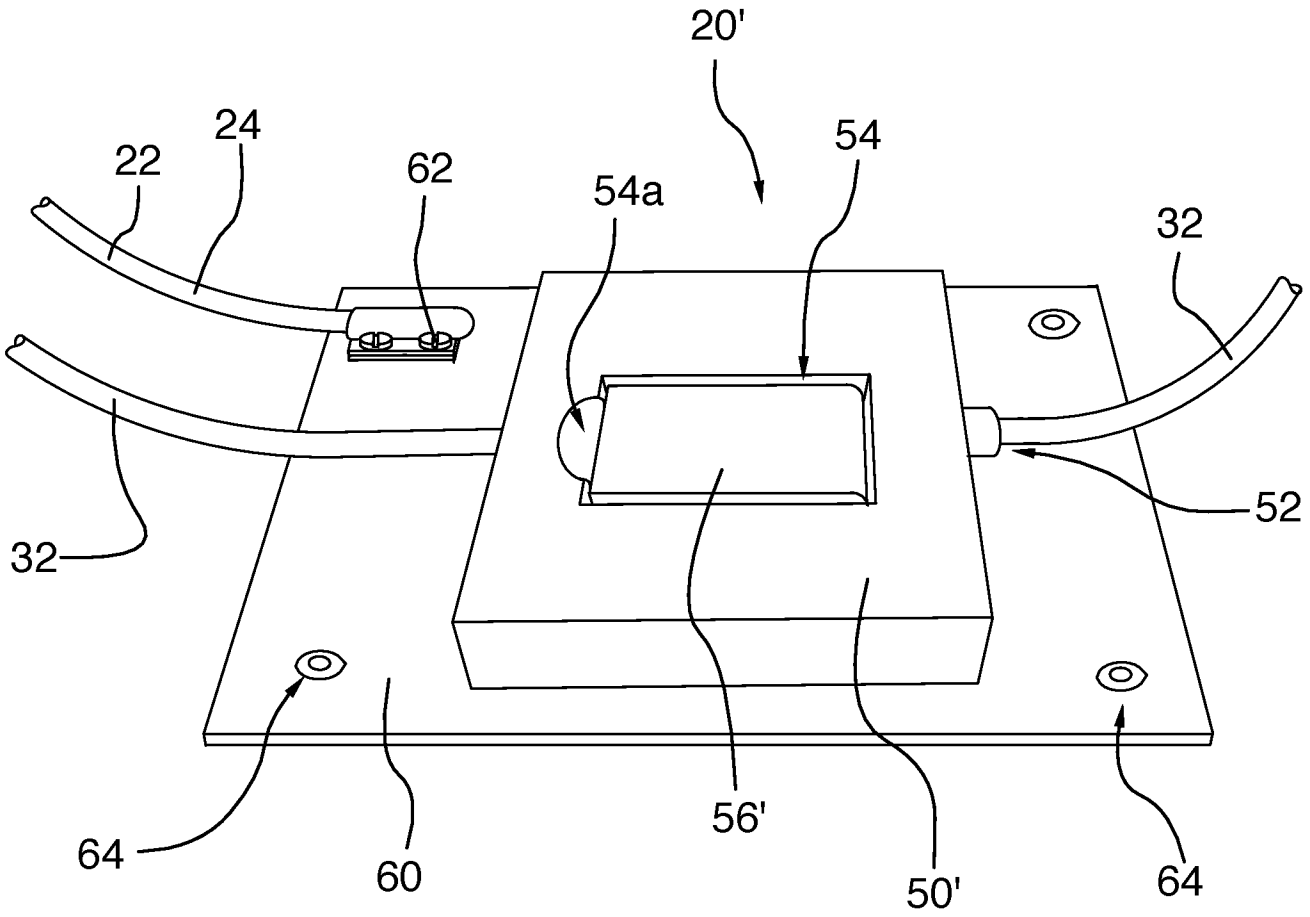
FIG. 12 is a close-up front left perspective view of an adjustable length cable lock device according to a second preferred embodiment of the invention, showing an affixing member and a cable tightening device thereof, shown in a cable secured configuration.
Figure 14:
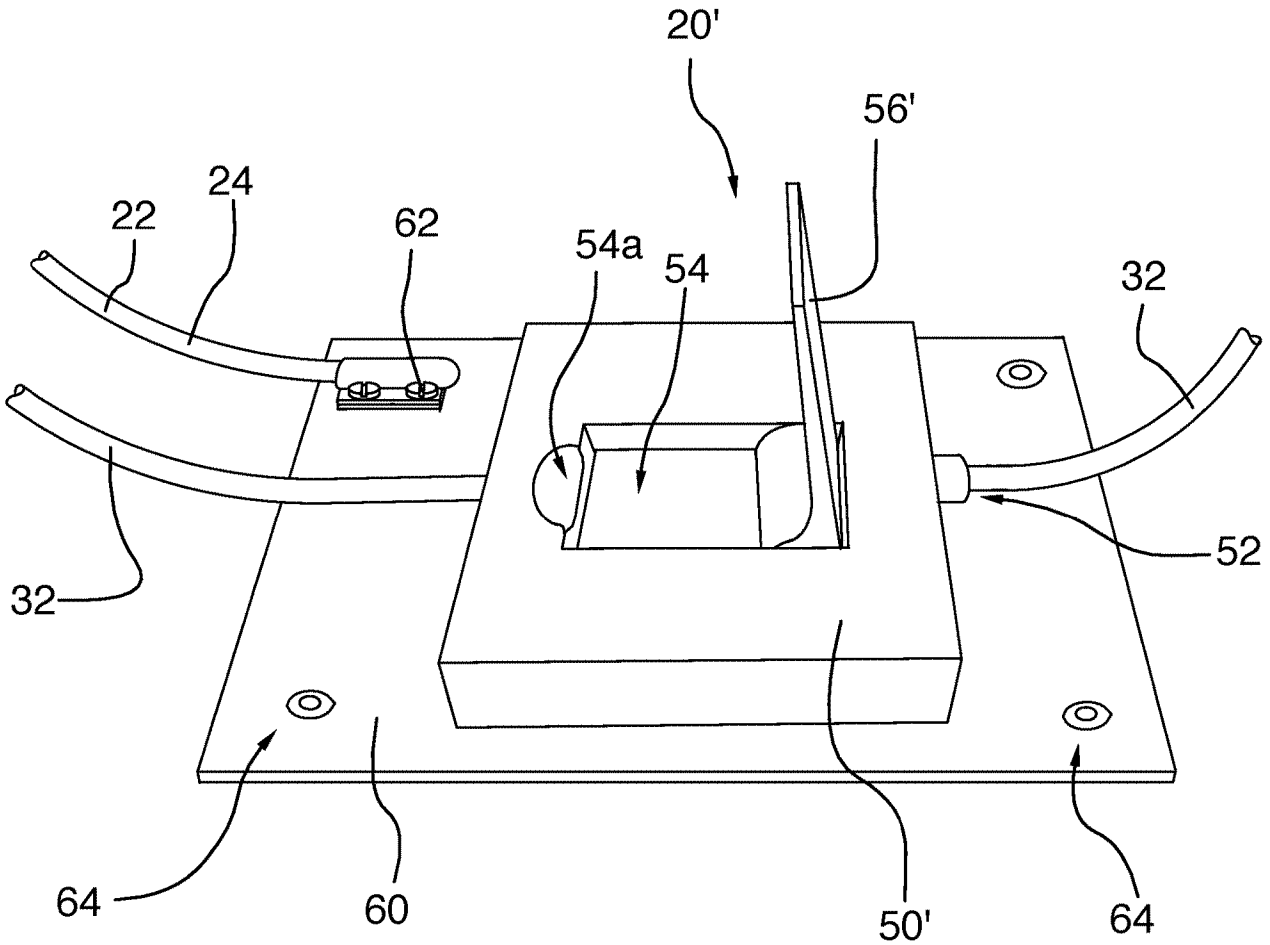
FIG. 14 is a close-up front left perspective view of the adjustable length cable lock device of FIG. 12, shown in a cable released configuration.

As shown in FIGS. 12 and 14, the cable tightening device 50' preferably defines a release aperture 54, including a finger release aperture 54*a*. The cable tightening device 50' preferably has a selectively actuable release mechanism 56', in the form of a release lever, which is accessible via the release aperture 54 and its finger release aperture 54*a*. The cable tightening device 50' preferably defines a cable passage 52 therethrough. Preferably, the second cable 32 slidably extends through the cable passage 52. Preferably, the cable tightening device 50 securely engages and permits longitudinal movement of the second cable 32 relative to the cable tightening device 50', but only in a tightening direction unless the release lever 56' is selectively actuated.

Figure 13:
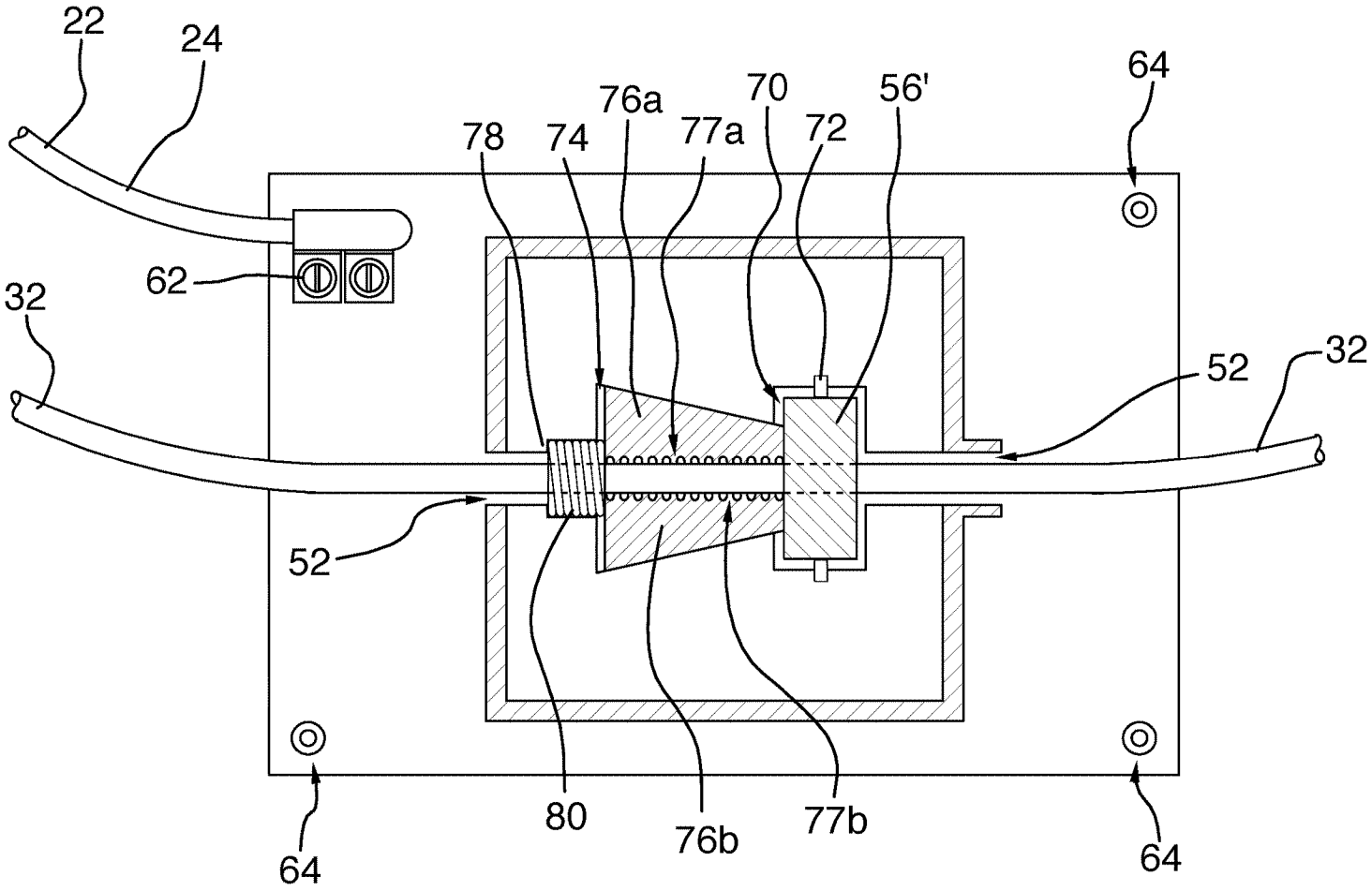
FIG. 13 is a front view of the adjustable length cable lock device of FIG. 12, with the cable tightening device shown in partial section and in the cable secured configuration.
Figure 15:
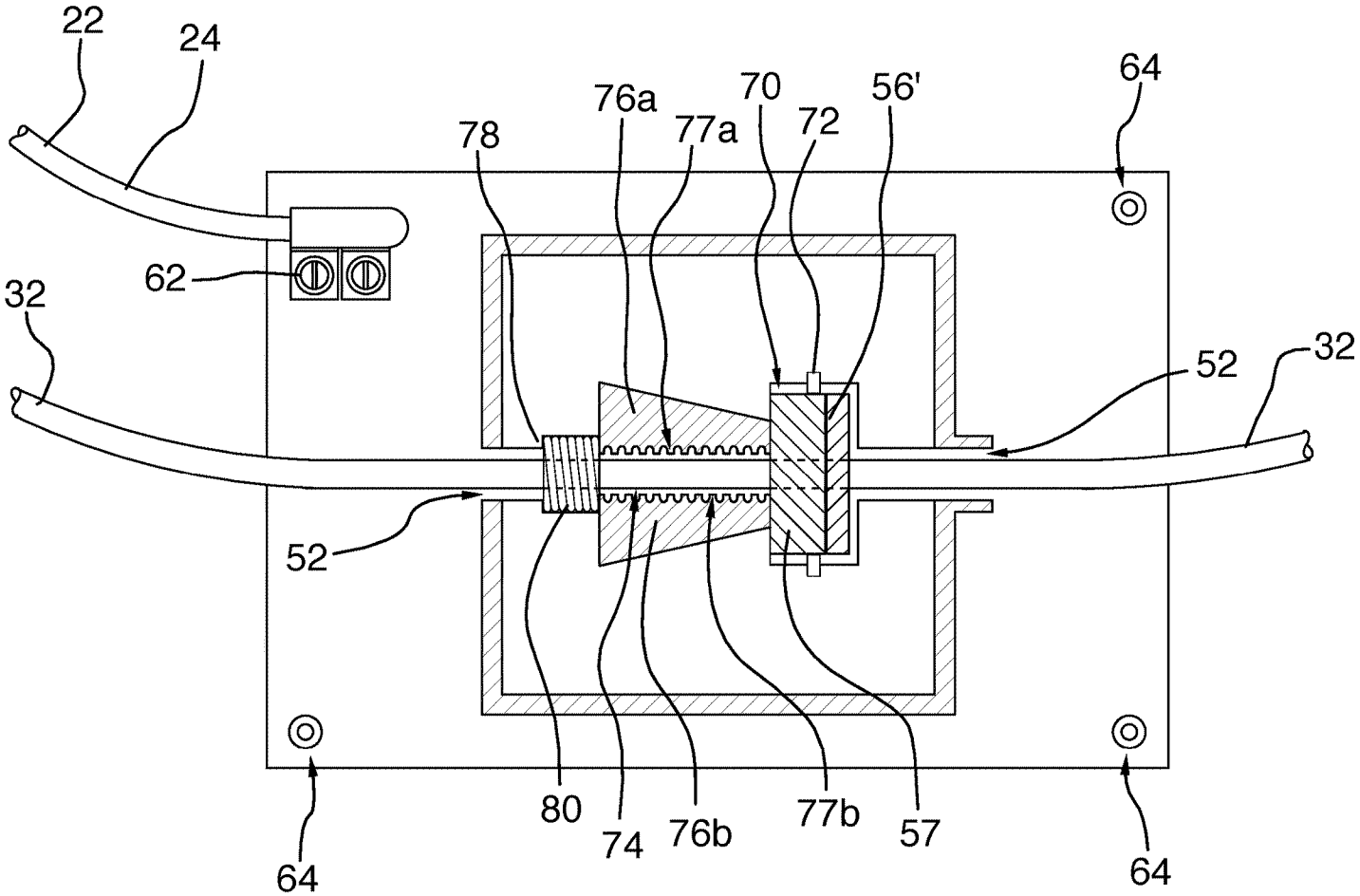
FIG. 15 is a front view of the adjustable length cable lock device of FIG. 12, with the cable tightening device shown in partial section and in the cable released configuration.

In the preferred embodiment shown in FIGS. 12 to 15, and as best seen in FIG. 15, the cable tightening device 50' includes a cam member 57, a spring member 80, and cable engaging members 76*a*, 76*b*, preferably, in the form of two opposing clamshell members on opposite sides of the second cable 32. Each of the clamshell members 76*a*, 76*b* has a respective gripping surface portion 77*a*, 77*b*. The spring member 80 engages a spring ledge 78. As best seen in FIG. 13, the spring member 80 extends into a clamshell chamber 74, and biases the clamshell members 76*a*, 76*b* into secure engagement of their gripping surface portions 77*a*, 77*b* with the second cable 32. The clamshell members 76*a*, 76*b* extend into a cam chamber 70. In the aforesaid secure engagement, movement of the second cable 32 is restricted other than in the tightening direction, unless the release lever 56' is selectively actuated.

The cam member 57 engages the release lever 56'. When the release lever 56' is selectively actuated, by pivoting it (as shown in FIGS. 14 and 15) and the cam member 57 about a cam pivot 72 (shown, for example, in FIG. 15), the cam member 57 pushes the clamshell members 76*a*, 76*b* back into the clamshell chamber 74 and out of the cam chamber 70. There, the spring member 80 is compressed, such that it no longer extends into the clamshell chamber 74. In this configuration, and as best seen in FIG. 15, the clamshell members 76*a*, 76*b* do not engage the second cable 32 and permit free longitudinal movement of the second cable 32 both in the tightening direction and otherwise.

Preferably, via the affixing member 60, the cable tightening device 50' (and the rest of the adjustable length cable lock 20') may be secured to the fixed object 18, e.g., a wall. Persons skilled in the art will appreciate from consideration of FIG. 11 that, when a package 16 is secured within the cable loop against the fixed object 18, the package 16 blocks the release aperture 54, including the finger release aperture 54*a*, to prevent access to the release mechanism 56'. Selective unlocking of the locking mechanism 40 preferably permits removal of the package 16 from the cable loop and ready access to the release mechanism 56' via the finger release aperture 54*a* of the release aperture 54.

In use, a courier delivery-person may arrive at a person's residence with a parcel 16. The adjustable length cable lock 20, 20' preferably may be mounted on the fixed object 18 (e.g., a wall of the residence) about one foot off the ground. The courier delivery-person then may simply use the lock fastener 46 to remove the cable loop from the fixed object 18, loop it around the parcel 16, and easily pull on the handle 36 to tighten the cable loop about the parcel 16.

The adjustable length cable lock 20, 20' will then be secure, and the delivery-person can move on to the next delivery, assured that the parcel 16 will be there waiting when the resident arrives home.

When the resident arrives home, the resident may then use the key 48 to unlock the padlock 40, remove the parcel 16, loosen the cable loop via the release lever 56, 56', and fasten the cable loop back onto the wall 18 using the lock fastener 46. The adjustable length cable lock 20, 20' will then be ready to securely receive another parcel 16 the next time a courier delivery-person comes calling.

According to the invention, the adjustable length cable lock 20, 20' may be produced, or used to secure or release a package, in accordance with various novel and inventive systems and methods. Those skilled in the art will appreciate, in view of the disclosures herein, that such systems and methods fall within the scope of the invention, as taught, disclosed and/or suggested herein, and/or circumscribed by the claims hereof and of any divisional, continuation, continuation-in-part, and/or re-issued patent(s) and patent application(s) claiming priority herefrom. Various components, relations, directions, and configurations may be common to the adjustable length cable lock 20, 20' and any associated systems or methods of the present invention. It should, however, be appreciated that, although some of the components, relations, directions, and configurations of the adjustable length cable lock 20, 20' are not specifically referenced or described herein in connection with any systems or methods according to the invention, they may be used, and/or adapted for use, in association therewith.

The adjustable length cable lock and package locking device, system, and method, according to the invention, preferably can be used to lock and secure parcels delivered by a courier.

The adjustable length cable lock and package locking device, system, and method, according to the invention, preferably include a cable tightening mechanism and a separate locking mechanism that does not directly affect the function of the cable tightening mechanism. The adjustable length cable lock and package locking device, system, and method, according to the invention, preferably also enable lengthening of the cable loop, while the cable loop is locked, if an item has not yet been secured by the device.

The adjustable length cable lock and package locking device, system, and method, according to the invention, preferably adjust to fit a wide variety of parcel sizes, and take a courier only a few moments (e.g., preferably within about 10-15 seconds) to secure a parcel.

Preferably, in use of the adjustable length cable lock and package locking device, system, and method according to the invention, a parcel is placed in a cable loop, and a handle on an end of the cable is pulled to tighten the cable about the parcel. Preferably, the cable moves freely through a mechanism to allow the cable to tighten about the parcel, and will not release until the owner unlocks and removes the parcel.

The adjustable length cable lock and package locking device, system, and method, according to the invention, preferably give a resident confidence that a parcel delivered to the resident's home, while the resident is away, will be there when the resident returns.

The adjustable length cable lock and package locking device, system, and method, according to the invention, preferably permit an owner to remove a first parcel and make them ready for a second parcel in only a few moments (e.g., preferably within about 20-30 seconds).

The invention is contemplated for use in association with courier delivery of parcels, to afford increased functionality and/or advantageous utilities in association with same. The invention, however, is not so limited.

The foregoing description has been presented for the purpose of illustration and is not intended to be exhaustive or to limit the invention to the precise form disclosed.

Naturally, in view of the teachings and disclosures herein, persons having ordinary skill in the art may appreciate that alternate designs and/or embodiments of the invention may be possible (e.g., with substitution of one or more components for others, with alternate configurations of components, etc). Although some of the components, relations, configurations and/or steps according to the invention are not specifically referenced in association with one another, they may be used, and/or adapted for use, in association therewith. All of the aforementioned, depicted and various structures, configurations, relationships, utilities and the like may be, but are not necessarily, incorporated into and/or achieved by the invention. Any one or more of the aforementioned structures, configurations, relationships, utilities and the like may be implemented in and/or by the invention, on their own, and/or without reference, regard or likewise implementation of any of the other aforementioned structures, configurations, relationships, utilities and the like, in various permutations and combinations, as will be readily apparent to those skilled in the art, without departing from the pith, marrow, and spirit of the disclosed invention.

Other modifications and alterations may be used in the design, manufacture, and/or implementation of other embodiments according to the present invention without departing from the spirit and scope of the invention, which is limited only by the claims hereof and of any divisional, continuation, continuation-in-part, and/or re-issued patent(s) and patent application(s) claiming priority herefrom

PARTS LIST

The following numbers have been used herein and in the accompanying drawings to denote certain parts, elements, and features of the invention:

Portable item 16
Fixed object (e.g., wall) 18
Adjustable length cable lock 20, 20'
Cable members 22,32
First cable 22
Secured end portion 24
First securing end portion 28
Second cable 32
Handle end portion 34
Handle 36
Second securing end portion 38
Locking mechanism 40
Lock fastener (e.g., Velcro, hook) 46
Key 48
Tightening device 50, 50'
Cable passage 52
Release aperture 54
Finger release aperture 54*a*
Release mechanism (e.g., lever) 56, 56'
Release cam portion 57
Affixing member 60
Cable fastener 62
Object fastener 64
Cam chamber 70
Cam pivot 72
Clamshell chamber 74
Clamshell gripping members 76*a*, 76*b*
Gripping surface portions 77*a*, 77*b*
Spring ledge 78
Spring 80
Cam aperture 90
Cam pivot 92
Release cam portion 97

The invention claimed is:

1. An adjustable length cable lock device, for use with a portable item and a fixed object, comprising:

a) an elongate first cable having a first securing end portion and a secured end portion, and an elongate second cable having a second securing end portion and a handle end portion, with the first cable and the second cable adapted to together extend in a cable loop about the portable item, and with the handle end portion having a handle adapted to be pulled to tighten the cable loop about the portable item;

b) a locking mechanism which securely locks the first and second securing end portions to each other in a locked configuration, and which is selectively unlockable to permit removal of the first and second securing end portions from each other;

c) a cable tightening device which: (i) has a selectively actuable release mechanism; (ii) securely engages the second cable while still permitting longitudinal movement of the second cable relative thereto, with said longitudinal movement permitted only in a tightening direction unless the release mechanism is selectively actuated; and (iii) defines a cable passage therethrough, with the second cable slidably extending through the cable passage and securely engaged by the cable tightening device; and d) an affixing member secured to the cable tightening device and the secured end portion of the first cable, with the affixing member for securing to the fixed object such that the first cable and, via the cable tightening device, the second cable are then secured to the fixed object;

wherein, in the locked configuration, said movement in the tightening direction operatively tightens the cable loop about the portable item towards a secured configuration; and wherein, in the secured configuration, the cable loop engages and secures the portable item against the fixed object, such that the portable item thus secured prevents access to the release mechanism, with the aforesaid selective unlocking of the locking mechanism permitting removal of the portable item from the cable loop and ready access to the release mechanism.

2. The adjustable length cable lock device according to claim 1, wherein the cable tightening device defines a release aperture, with the release mechanism accessible via the release aperture, and wherein the portable item, when secured by the cable loop against the fixed object, blocks the release aperture to prevent access to the release mechanism.

3. The adjustable length cable lock device according to claim 2, wherein the release mechanism comprises a release lever.

4. The adjustable length cable lock device according to claim 3, wherein the cable tightening device comprises a cam member engaging the release lever; wherein the cam member securely engages the second cable, so as to restrict movement other than in the tightening direction, unless the release lever is selectively actuated; and wherein, when the release lever is selectively actuated, the cam member disengages the second cable and permits free longitudinal movement of the second cable both in the tightening direction and otherwise.

5. The adjustable length cable lock device according to claim 3, wherein the cable tightening device comprises a cam member and one or more cable engaging members biased into secure engagement with the second cable, so as to restrict movement other than in the tightening direction, unless the release lever is selectively actuated; wherein the cam member engages the release lever and, when the release lever is selectively actuated, the cam member pushes the cable engaging members out of engagement with the second cable and permits free longitudinal movement of the second cable both in the tightening direction and otherwise.

6. The adjustable length cable lock device according to claim 5, wherein each of the cable engaging members has a gripping surface portion adapted for said secure engagement with the second cable.

7. The adjustable length cable lock device according to claim 6, wherein the cable tightening device comprises a spring member biasing the cable engaging members into secure engagement with the second cable.

8. The adjustable length cable lock device according to claim 7, wherein said cable engaging members comprise two opposing clamshell members, on opposite sides of the second cable, each biased into said secure engagement with the second cable.

9. The adjustable length cable lock device according to claim 1, wherein the locking mechanism comprises a padlock which may be unlocked by a key.

10. The adjustable length cable lock device according to claim 1, wherein the affixing member comprises one or more cable fasteners, and wherein the secured end portion of the first cable is secured to the affixing member by the cable fasteners.

11. The adjustable length cable lock device according to claim 1, wherein the affixing member comprises one or more object fasteners, wherein the affixing member is secured to the fixed object by the object fasteners.

12. An adjustable length cable lock device according to claim 1, wherein the locking mechanism has a lock fastener which may be selectively fastened to the fixed object when the adjustable length cable lock is not in use, and/or unfastened from the fixed object when the adjustable length cable lock is in use.

13. A package locking system comprising a portable item, a fixed object, and the adjustable length cable lock device according to claim 1, with the adjustable length cable lock device releasably securing the portable item to the fixed object.

14. A package locking method of using the adjustable length cable lock device according to claim 1 to secure a portable item to a fixed object, wherein the package locking method comprises the steps of:

a) placing the cable loop, formed by the first cable and the second cable of the adjustable length cable lock device, around the portable item; and b) pulling on the handle of the adjustable length cable lock device to tighten the cable loop about the portable item into the secured configuration of the adjustable length cable lock device, whereat the cable loop engages and secures the portable item against the fixed object, such that the portable item thus secured prevents access to the release mechanism of the adjustable length cable lock device.

15. The package locking method according to claim 14, further comprising step (c), after said step (b), of selectively unlocking the locking mechanism of the adjustable length cable lock device to permit removal of the portable item from the cable loop and ready access to the release mechanism.

16. The package locking method according to claim 15, further comprising step (d), after said step (c), of selectively re-locking the locking mechanism of the adjustable length cable lock device to re-form the cable loop and selectively actuating the release mechanism and loosening the cable loop to ready the adjustable length cable lock device to securely receive another portable item.

17. The package locking method according to claim 16 wherein, in step (d), the locking mechanism has a lock fastener which is removably fastened to the fixed object when not in use.

18. The package locking method according to claim 14, further comprising step (i), before step (a), of mounting the adjustable length cable lock device on the fixed object about one foot off the ground.

19. The package locking method according to claim 14, further comprising step (ii), before step (a), wherein the locking mechanism has a lock fastener, removably fastened to the fixed object, which is unfastened from the fixed object prior to use of the cable loop in step (a).

* * * * *